US005915560A

United States Patent [19]

George et al.

[11] Patent Number: 5,915,560

[45] Date of Patent: Jun. 29, 1999

[54] COMPARTMENTALIZED PILL DISPENSER

[76] Inventors: Donald C. George, 4621 Via Gennita, Santa Barbara, Calif. 93111; Dean T. Upton, 2330 Las Canoas Rd, Santa Barbara, Calif. 93111; Arthur S. Chapman, 840 Marcelino Dr., Solvang, Calif. 93464

[21] Appl. No.: 08/850,579

[22] Filed: May 3, 1997

[51] Int. Cl.[6] ..... B65D 83/04

[52] U.S. Cl. ..... 206/537; 206/536; 206/535

[58] Field of Search ..... 206/528, 535, 206/536, 537, 540

[56] References Cited

U.S. PATENT DOCUMENTS

| | | | |
|---|---|---|---|
| 1,289,446 | 12/1918 | Griffiths . | |
| 1,485,716 | 3/1924 | Rogers . | |
| 2,763,956 | 9/1956 | Olson . | |
| 3,162,301 | 12/1964 | Cage, Jr. | 206/535 |
| 3,251,459 | 5/1966 | Lacour . | |
| 3,604,581 | 9/1971 | Van Iperen | 206/536 |
| 3,654,890 | 4/1972 | Rigney et al. | 206/536 |
| 3,688,945 | 9/1972 | Harmon, Jr. et al. . | |
| 3,783,089 | 1/1974 | Hurst et al. . | |
| 4,054,208 | 10/1977 | Lowe . | |
| 4,101,029 | 7/1978 | Feinberg et al. . | |
| 4,294,361 | 10/1981 | Margulies et al. . | |
| 4,381,059 | 4/1983 | Schurman . | |
| 4,420,076 | 12/1983 | Beveridge et al. | 206/528 |
| 4,465,191 | 8/1984 | Darbo | 206/537 |
| 4,588,090 | 5/1986 | Spuck et al. . | |
| 4,627,432 | 12/1986 | Newell et al. . | |
| 4,756,407 | 7/1988 | Larsen | 206/528 |
| 4,778,054 | 10/1988 | Newell et al. . | |
| 4,905,866 | 3/1990 | Bartell et al. . | |
| 4,998,623 | 3/1991 | Doull . | |
| 5,019,125 | 5/1991 | Rebne et al. . | |
| 5,109,984 | 5/1992 | Romick . | |
| 5,118,007 | 6/1992 | Lewis et al. . | |
| 5,163,559 | 11/1992 | Bunin . | |
| 5,269,413 | 12/1993 | Stern . | |
| 5,318,824 | 6/1994 | Itaya et al. . | |
| 5,332,096 | 7/1994 | Battaglia . | |
| 5,348,158 | 9/1994 | Honan et al. . | |
| 5,356,010 | 10/1994 | Weinstein . | |
| 5,368,187 | 11/1994 | Poncetta et al. . | |
| 5,431,283 | 7/1995 | Weinstein et al. . | |
| 5,469,968 | 11/1995 | Matthews et al. . | |
| 5,486,390 | 1/1996 | Burns et al. . | |
| 5,522,506 | 6/1996 | Roulin et al. . | |
| 5,620,109 | 4/1997 | Madden | 206/536 |

FOREIGN PATENT DOCUMENTS

| | | | |
|---|---|---|---|
| 177682 | 5/1957 | Sweden | 206/536 |

*Primary Examiner*—David T. Fidel
*Attorney, Agent, or Firm*—Richard T. Lyon

[57] ABSTRACT

This invention relates to a compartmentalized pill dispenser that is small enough to be carried with the user at all times, seals the pills against moisture and other degrading elements, protects the pills against vibration and is easy to use by an impaired person in an emergency situation. The dispenser has a protective outer case which encases the internal pill carrier which having compartments for pills on one side thereof. The pill carrier is sealed within the sheath by a water-tight mechanism. The pill carrier is extended out of the case in one pill compartment increments to expose a pill.

60 Claims, 6 Drawing Sheets

COMPARTMENTALIZED PILL DISPENSER

BACKGROUND OF THE INVENTION

1. Technical Field

This invention relates to a pill dispenser. More particularly, this invention relates to a compartmentalized pill dispenser that is small enough to be carried with the user at all times, seals the pills against moisture and other degrading elements, protects the pills against vibration and is easy to use by an impaired person in an emergency situation.

2. Background Art

There are many instances where a person is required, due to illness, to carry medicine, such as pills and capsules, with them to be taken at prescribed times or upon the indication of need. An example of such a situation would be a person who has angina pectoris. In the case of an angina attack, an emergency arises due to deficient oxygenation of the heart muscles. This emergency requires an immediate dosage of nitroglycerin to be orally administered by the person affected. Since time is of the essence a person must, as of necessity, carry the pills on their person at all times and administer them immediately when an emergency situation arises. In such an emergency situation, a lapse of even a few minutes without administration of the medication could be harmful or even fatal.

It is conventional practice that persons who are required to carry pills with them at all times to keep these medications in their original containers. One drawback of this practice is that many such containers are bulky and are not easily carried in one's pockets. Another drawback that can result in dire consequences is that a person must first remove the cap of the container, remove the cotton stuffing and then single out a one small pill for ingestion. Often this problem is made more difficult if the person requiring the medicine has trembling or shaking hands or the container has a child-proof cap. Additionally, such an emergency situation may occur at night or while the victim is driving, or poor eyesight may make it particularly difficult for him or her to single out the tablet or pill and take it before their condition worsens. If the pills are spilled the user may not be able to find them in time to prevent harm.

It is also known for person's required to carry pills with them to employ a small container. For example, nitroglycerin tablets are often carried in a small tube with an inside diameter just larger than the pills themselves. Usually five to seven pills are stacked one on top of another in this tube. Unfortunately, these containers are known to fail such as when the cap which seals the tube becomes cross-threaded and stuck thereby making it difficult to remove the cap. Sometimes the pills are crushed by the cap if too many are loaded within the dispenser. If space is left to avoid this problem vibration of the pills increases. Vibration has been known to powderize the nitroglycerin pills to the point where they become jammed within the tube and cannot be extracted. Additionally, when the pills become powderized the dosage is then uncertain. Another problem with these tube dispenser is that like the larger bottles, the pills stacked within the tube can be easily spilled; this is especially true when the user is having some kind of attack. The dispenser is also difficult to load, especially for someone with poor sight, because it is often difficult to ascertain the number of pills within the container.

Additionally, many pill dispensers of the prior art do not protect the pills or tablets against moisture, light or other degrading effects. This is important as some medications are detrimentally affected by these environmental factors. For example, nitroglycerin degrades substantially when exposed to moisture or light and the pills are easily pulverized when exposed to vibration.

One attempt at resolving the access and spilling problems involved a pen-shaped dispenser, having an elongated hand-held core with a plurality of cavities adapted to contain pills or tablets. A sheath, open at both ends, surrounds the core which is slideable from a position covering all of the cavities to another position uncovering the cavities. A detent mechanism is employed between the sheath and the core for interrupting the sliding movement after each of the cavities is uncovered. For spatially orienting the tablet dispenser, and without the need to look at it, distinct physical touch indicia are fixed to the dispenser in lengthwise alignment with the tablet cavities. Although this pill dispenser resolved some of the problems associated with carrying pills on the person at all times, other persist. For instance, although the core and the sheath of the container are in close proximity to each other, there is not a water-tight seal between the core and the sheath of the container. This allows air and water to enter the dispenser and degrade the pills or tablets over time. Additionally, although the container is smaller than some of the prior art, its size is still substantial when considering its user would have to carry it with them constantly. Its length approximates that of a pen--on the order of six inches in length. In fact, the container purposely had an extension and pen clip such that the container could be carried in one's shirt pocket. Since women, and many men, usually do not place pens in any shirt pocket they might have, this would render the dispenser somewhat impractical for a person to carry with them.

To prevent the common pill dispenser problems, a better pill dispenser than is provided by the current technology is desirable. Ideally, this pill dispenser should be easy to use even when the user is in an impaired state. It should also be light-weight and small enough to take with one at all times. It should be able to dispense individual doses of medicine without the user having to touch them. Additionally, it should protect the pills from the effects of moisture, sunlight, air, and vibration. It is also necessary that the pill dispenser be made of materials that do not react with the pills thereby contaminating them.

SUMMARY

The foregoing desirable pill dispenser qualities have been achieved by a new type of compartmentalized pill dispenser for patients who must carry medication with them at all times, such as heart patients who must carry nitroglycerin tablets. It is the general aim of the present invention to provide a pill dispenser which is easily carried on one's person, and which can be pre-loaded with pills at the user's convenience, and later dispense the exact number of pills and dosage required. In this way, the user does not have to separate one pill or tablet from a container of pills. Further, the dispenser is designed so that one does not have to pick the pill up with their fingers to place it in their mouth. Specifically, the dispenser allows a pill to be placed directly into the mouth of the patient without having to first handle it. This precludes the possible contamination of the pill, for example by a patient having wet or sweaty hands at the time of an attack. The present invention also includes features which permit a pill to be dispensed without having to visually orient the dispenser so that the pill can be transferred quickly in the mouth. A primary version of the pill dispenser protects medicines, such as nitroglycerin, which are susceptible to degradation from moisture, high temperatures and light, from these environmental effects. Further, the dispenser exhibits shock resistant qualities to protect the pills. For example, nitroglycerin pills are very soft, having a consistency similar to compacted powdered sugar. Such pills are easily powderized if subjected to shock. Thus, reducing the amount of vibration and shock subjected on a pill will minimize any powderization. Further, even if some powderization of the pills occurs, the dosage will still be exact since the entirety of the pill will be contained within the compartmentalized pill cavity and can be transferred in total to the mouth. Additionally, the materials making up the dispenser do not react with the medicine. Most importantly, the dispenser is easy to operate by the patient who may be older or incapacitated (such as by a heart patient having an attack of angina which requires the immediate ingestion of a nitroglycerin pill). And finally, the dispenser is capable of being filled by the user with confidence or even pre-filled by a pill manufacturer.

These above-described features are embodied in a compartmentalized pill dispenser having a protective outer sheath which encases an internal pill carrier having compartments for the pills on one side thereof. The sheath can be completely closed on all but a forward end, into which the pill carrier is inserted. If the sheath employs a closed aft end, a pressure relief element is added. This pressure relief element can take the form of a simple through-hole in the closed end of the sheath which lets air into the sheath when the pill carrier is pulled out and lets air out of the sheath when the pill carrier is drawn into the sheath. Alternately, a two-way valve could be installed in the through-hole. This valve would allow air into the sheath only when the pill carrier is moved out of the sheath and allow air out of the sheath only when the pill carrier is moved into the sheath. In this way, the area between the sheath and the pill carrier remains sealed at all other times to prevent contamination from entering the through-hole. In versions of the sheath employing an open aft end for easier cleaning, there is no need for the aforementioned pressure relief element and so it is not included.

The pill carrier is extended out of an open end of the case in "one pill compartment" increments to expose a pill. The other pills remain within the case and protected from the outside environment. One way of accomplishing the extension of the pill carrier is via a screw mechanism wherein the patient turns the pill carrier relative to the case. Alternately, the extension can be accomplished by sliding the pill carrier linearly once unlocked from the case. The locking mechanism could be a screw arrangement disposed at the rear of the pill carrier which interfaces with the case. In the embodiments employing a twisting motion to extend the pill carrier and expose a pill compartment, the screw mechanism is preferably designed to extend the pill carrier the desired amount in response to "one ergonomic turn" (e.g. about 140 degrees). In the embodiment employing the sliding scheme, a detent mechanism could be added to provide the desired incrementation to the extension process. Detents could also be added to the twist embodiments as well. The case and pill carrier preferably have structures that allow the patient to identify the "top" (i.e. the direction the pill compartments face), either by sight or by touch. This prevents the dispenser from being inadvertently opened with a pill compartment facing downward, thereby causing a pill to fall out. The pill compartments could also have a protective seal, such as a piece of tape, which must be removed once the pill carrier is extended in order to release the pill. This would further prevent inadvertently spilling of the pill and could enhance the environmental seal. It is also noted that once the pill is exposed in any of the embodiments it can be emptied into the patent's mouth without having to be handled. This has further advantage in that even if the pill has been fractured or powderized to some extent, the entire dose is still ingested.

The materials chosen for the case and pill carrier must provide the aforementioned security, isolation from the external environment (including shock, heat, moisture, and light), and non-reactance to the pills. The preferred materials are plastics and metals. It is believed a plastic material, such as Teflon, would be most suitable. Teflon is light, thus making it is easy for the user to carry the container. Additionally, Teflon readily slides against itself and therefore makes the dispenser easy to slide open in those embodiments employing a sliding mechanism. Further, Teflon does not wick water, further enhancing the water-tightness of the dispenser to protect the pills therein from environmental effects. Teflon is also opaque and thereby prevents light from reaching and degrading the pills. Certain metals are acceptable for use with this invention as well. Such a case could be made thinner than a plastic case, and so reduce the size and possibly the weight of the dispenser. All metals will prevent light from entering the container. Aluminum is the preferred metal in that it is light-weight and does not react with most medicines. Brass could also be employed, but for some medicines, such as for nitroglycerin, a container made of brass would have to be nickel coated, since brass has a tendency to react with nitroglycerin. Alternately, the pill dispenser could be made of plastic such as Teflon, and the exterior of the case, and/or the pill carrier, could be coated with metal for wear resistance and aesthetic purposes or metal coated with Teflon. The dispenser can also be colorized or color coded to designate the type of medication contained therein. For example, the housing could be colored or color coded. Alternately, the housing could be made of a transparent plastic and the pill carrier could be colored or color coded. Further, the color or color coding employed could be made to match that used by the pill manufacture on the pills themselves.

BRIEF DESCRIPTION OF THE DRAWINGS

The specific features, aspects and advantages of the present invention will become better understood with regard to the following description, appended claims, and accompanying drawings where:

DETAILED DESCRIPTION OF THE PREFERRED EMBODIMENTS OF THE INVENTION

In the following description of the preferred embodiments of the present invention, reference is made to the accompanying drawings which are a part hereof, and which is shown by way of illustration specific embodiments in which the invention may be practiced. It is understood that other embodiments may be utilized and structural changes may be made without departing from the scope of the present invention.

Figure 1:
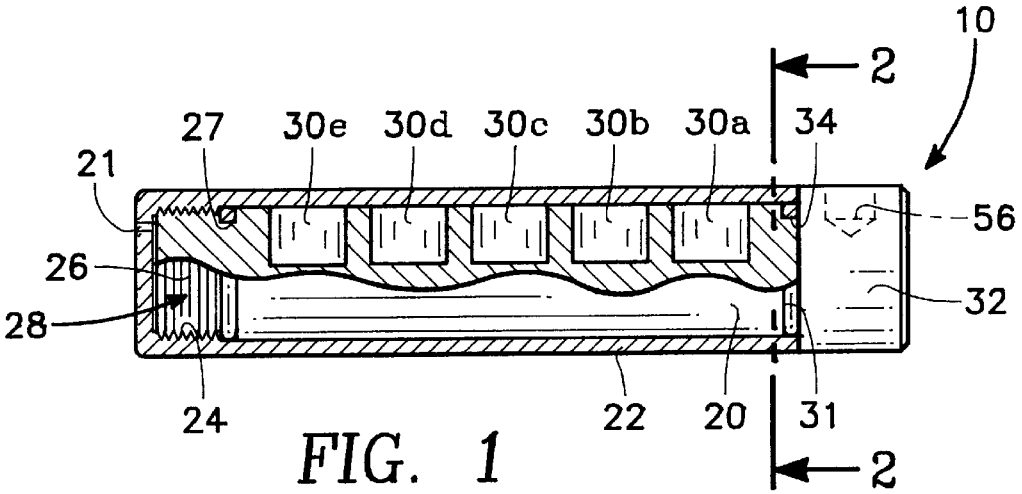
FIG. 1 is a side view of the pill dispenser constructed according to one embodiment of the invention employing a screw mechanism to turn the pill carrier relative to the sheath and a sliding scheme to open the container.
Figure 2:
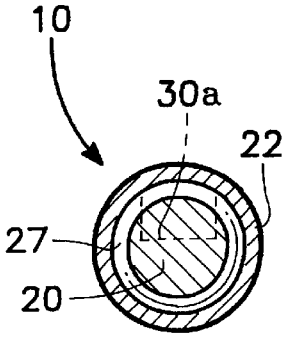
FIG. 2 is a cross-sectional view of the pill dispenser of FIG. 1.

FIGS. 1 and 2 show one embodiment of the pill dispenser 10 constructed in accordance with the principles of the present invention. The cross-section of the dispenser 10 is generally round as shown in FIG. 2. The dispenser 10 includes as primary components a pill carrier 20 with a plurality of pill cavities 30*a*–30*e*, and a sheath 22 encasing the pill carrier 20. Each cavity 30*a*–30*e* is sized such that it is just slightly larger than one pill. Thus, there will be little room for the pill to move within the cavity so as to minimize vibration of the pills, but still enough space that the pill will easily fall out of the cavity when the user wishes to ingest the pill. FIG. 1 shows the pill dispenser as it appears before the cavities 30*a*–30*e* are filled with pills. The cavities 30*a*–30*e* for receiving the pills are located on the pill carrier 20 directly under and thereby covered by the slideable sheath 22. The sheath 22 is completely closed on all sides with exception of the end through which the pill carrier 20 is inserted. However, there is a pressure relief channel 21 formed in the aft end of the sheath 22. This channel 21 is needed to exhaust air trapped behind the pill carrier 20 when the pill carrier is moved into the sheath, and to let air into the space behind the pill carrier when it is moved out of the sheath. The channel 21 is depicted as a simple through-hole, and this is adequate for most applications. However, a 2-way valve (not shown) can also be incorporated into the channel 21, if desired. Such a valve would open to allow air out of the sheath 22 only when excess pressure builds up within due to the pill carrier 20 being moved into the sheath, and open to allow air into the sheath only when a vacuum is created by the pill carrier being moved out of the sheath. This valve has the advantage of preventing dirt, debris, moisture, and other contaminants from entering the sheath through the channel 21, such as might occur when the dispenser is carried in a pocket or hand bag. Two-way valves of the type appropriate the above-described pill dispenser are known in the art and any may be employed. As these valves do not form a novel part of the present invention, no further detail will be provided herein. It is noted, however, that the issue of contaminants entering through the channel 21 is merely one of keeping the aft end of the sheath clean. The O-ring 27 disposed at the aft end of the pill carrier 20 will prevent any contamination from reaching the pill chambers or the pills held therein. The overall size of the dispenser may be made much smaller than the size of a pencil or pen, and is for the most part dictated by the size and number of pills the dispenser is to hold.

The dispenser 10 has threads 24 on one end of the sheath 22. The pill carrier 20 also has at one end 28 threads 26 designed to mate with the threads 24 on the sheath 22. On the opposite end of the pill carrier from the threaded end, an extension 31 connects an end cap 32 to the pill carrier 20. The extension 31 is surrounded by an O-ring 34. The O-ring 34 serves to provide a water and air tight seal at one end of the pill carrier. As mentioned above, another O-ring 27 serves to seal the portion of the pill carrier 20 forward of the threaded end 28 from moisture and other contaminants. The user of the dispenser 10 of this embodiment unscrews the sheath 22 from the pill carrier 20 by holding the end cap 32 and then turning the sheath 22 and then pulls the sheath 22 while holding onto the end cap 32 to slide the sheath 22 away from the threaded end 24 of the pill carrier 20 thereby exposing the first pill cavity 30*a*. It is a simple matter to slide the sheath 22 toward the unthreaded end 26 of the pill carrier 22 thereby sequentially exposing the remaining pills one at a time should more than one pill be required. The pill dispenser can be manipulated with one hand so that the pill contained within the cavity 30*a* can be taken by simply putting the entire end of the dispenser in one's mouth. This feature of the invention provides the advantage of allowing the user to take the pill without contaminating it by touching it. Of course, a pill can also be dispensed into a person's hand and then transferred to the mouth.

After the dispenser 10 is empty, or one or more pills have been taken, additional pills can be individually loaded into the cavities 30*a*–*e*, and the sheath 22 can be slideably moved against the threaded end 24 thereby covering the tablet-filled cavities and preparing the dispenser for future use.

Figure 4:
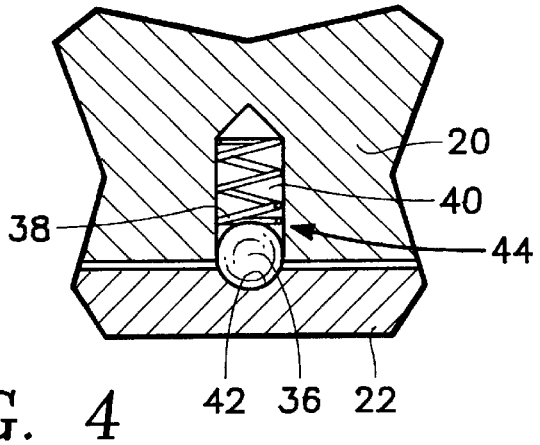
FIG. 4 provides an enlarged view of the detent mechanism shown in FIG. 3.
Figure 3:
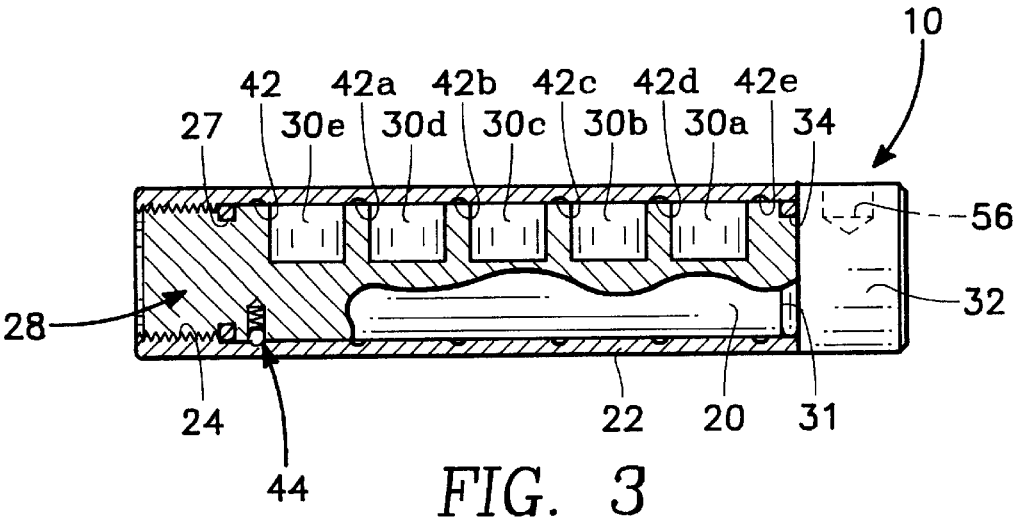
FIG. 3 is a side view of the embodiment of FIG. 1 modified to include a detent mechanism.

A detent mechanism may also be provided. FIG. 3 shows the embodiment of FIG. 1 with the detent mechanism 44 employed. An enlarged depiction of the detent mechanism is provided in FIG. 4. This detent arrangement 44 includes a ball 36 and a compression spring 38 disposed in a well 40 formed in the pill carrier 20. By this arrangement, the ball 36 is biased against the inside surface of the sheath 23. Along the inner circumference of the sheath 23 there are formed a plurality of spaced-apart detent grooves 42*a*–42*e* of diameter somewhat smaller than the ball 36. The spring 38 urges the detent ball 36 into one of the grooves 42*a*–42*e* such that the slideable movement of the sheath 23 is interrupted at each engagement of a detent groove 42*a*–*e*. The detent grooves 42*a*–42*e* are spaced a distance in direct correspondence to the spacing of the cavities 30*a*–30*e*. Moreover, the location of the detent grooves 42*a*–42*e*, as compared to the sheath edge is important insofar as the edge is disposed between the pill cavities when the detent ball 36 is engaged with one of the detent grooves 42*a*–42*e*. Thus, the ball 36 engages a detent groove 42 each time a pill compartment is exposed. The spring 38 applies a force to the ball 36 sufficient to "positively" stop the pill carrier 20 as each pill compartment 30 is exposed, but not so strong that it cannot be readily overcome by a user sliding the pill carrier 20 in relation to the sheath 23.

FIG. 3 also depicts an alternate structure for the sheath 23. In this alternate structure, the threads 24 extend all the way to the outside, thereby creating an open end at both sides of the sheath. Of course, since the aft end of the sheath 23 is open, there is no need for a pressure relief channel. This open aft end version of the sheath 23 has an advantage in that the sheath is easier to clean. However, it does not provide the same degree of protection from infiltration of contaminants as the closed end embodiments should the aft O-ring 27 fail to perform adequately.

It is known that the shelf life of many medicinal pills, such as nitroglycerin, is reduced when they are exposed to air, moisture or light. The sealing of the pill cavities to prevent exposure of the pills contained therein to the elements is accomplished by O-rings 27 and 34 located at each end of the pill carrier 20 as shown in FIGS. 1 and 3. It can be seen from FIGS. 1 through 4 that the internal cross-sectional configuration of the sheath 23 conforms to that of the pill carrier 20. These elements are preferably constructed so that the sheath 23 freely slides, except for the detent arrangement, on the pill carrier 20. The O-rings 27 and 34 provide a water-tight seal of the pill carrier 20 within the sheath 23, thereby protecting the pills within the sheath 23 from atmospheric effects such as air or moisture.

The materials chosen for the dispenser must provide isolation from the external environmental factors such as shock, heat, moisture, and light. In addition, the materials must not react chemically with the pills. The preferred materials for manufacture of this dispenser are, in general, plastics and metals. It is believed a plastic material, such as Teflon, would be most suitable. Teflon is lightweight and slick, sliding easily against itself, and therefore makes the dispenser easy to carry and slide open. Further, Teflon does not wick water, additionally enhancing the water-tightness of the dispenser, and is opaque and resistant to heat, and therefore a dispenser made of Teflon will protect the pills therein from environmental effects, such as moisture, light and heat. Additionally, a Teflon to Teflon interface will naturally seal, therefore superiorly sealing a dispenser made of Teflon or coated with Teflon. This is true even when the dispenser is partially opened, assuming a slight jam fit between the pill carrier and sheath. Certain metals are acceptable for use with this invention as well. A metal case could be made thinner than a plastic case, and so reduce the size and possibly the weight of the dispenser. All metals will prevent light from entering the container. Aluminum is the preferred metal in that it is light-weight and does not react with most medicines. Brass could also be employed, but for some medicines, such as for nitroglycerin, a container made of brass would have to be nickel plated, since brass has a tendency to react with nitroglycerin. Alternately, the pill dispenser could be made of plastic such as Teflon, and the exterior of the case, or exposed portion of the pill carrier, could be covered with other materials such as aluminum for wear resistance and aesthetic purposes. It is also possible to have the dispenser be made of metal with a Teflon coating, whereby the Teflon facilitates the relative movement between the sheath and the pill carrier.

In accordance with another aspect of the present invention, and with reference back to FIG. 1, a hole 56, is provided for spatially orienting the dispenser by the feel of the hole with the fingers or thumb. This hole 56 provides a visual and tactile indicator of the "top" of the dispenser, ie., the position corresponding to the open end of the pill compartments. In association with this groove, the user will know that the pill dispenser is properly oriented so that a pill will not inadvertently fall out before the dispenser end is inserted into the mouth or hand. By ensuring the "top" is facing upward, the tactile aspect of the hole 56 permits a person, while driving or in the dark, to quickly orient the tablet dispenser without the need of the visual sense. Alternately, this hole 56 can be threaded and an attachment, such as an eye stud, with mating threads could be screwed into the hole 56. The end of this attachment would extend away from the end cap 32 and would include a provision to attach a chain or key ring. For instance, this provision could take the form of a hole through which the chain or key ring is threaded. This feature of this invention allows the dispenser to be easily carried with the user. The attachment also still provides the indicator of the "top" of the dispenser such that the dispenser can be properly oriented without visual sense. It should be understood, however, that those skilled in the art may prefer other indicia capable of being ascertained by sight, or touch, for properly orienting the pill dispenser.

The compartmentalized nature of this dispenser 10 prevents the prior art pill dispenser problems where the pills stuck together and could not be extracted from the container. Additionally, this feature provides protection of the pills from vibration. The pill dispenser 10 can also be made smaller than other prior art pill dispensers having individual pill compartments owing to the size of the compartments just exceeding that of the pills. The smaller size of the present invention also allows the container to be more easily carried with a person at all times. The dispenser is easy to open, which is an advantage if the user is shaking or has any infirmity. Additionally, with the construction of this pill dispenser it is ensured that when the sheath 22 is slideably moved from one detent position to another, only one pill cavity becomes uncovered. This design feature precludes spilling of the pills. Additionally, the user need not visually ascertain whether the sheath has been moved a specified distance to uncover a pill, but rather need only feel with the fingers the pressure differential in moving the sheath 22 from one detent position to another. This aspect of the invention, in addition to the hole 56 on top of the dispenser, facilitates to a high degree the use of the pill dispenser in darkness, or while driving a vehicle. The fact that the pills remain sealed inside the sheath and pill carrier, providing a water-tight seal, prevents their degradation due to environmental factors and also is an advantage over the prior art. The materials chosen for this invention are non-reactive with the medications contained therein, and protect them from the degrading effects of light or other atmospheric effects.

Figure 5:
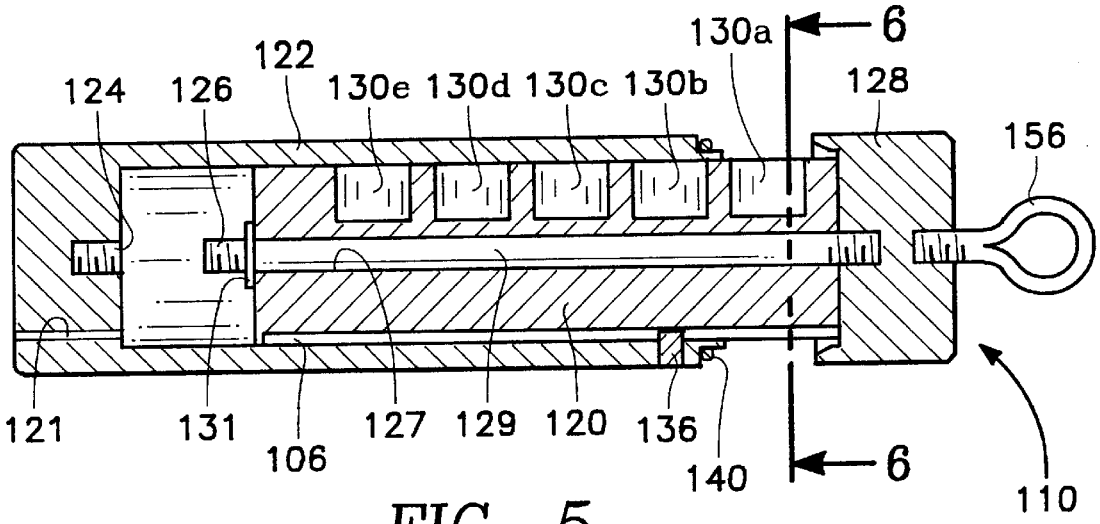
FIG. 5 is another embodiment of the present invention wherein a threaded pin is employed and a sliding scheme is utilized to open the container.
Figure 6:
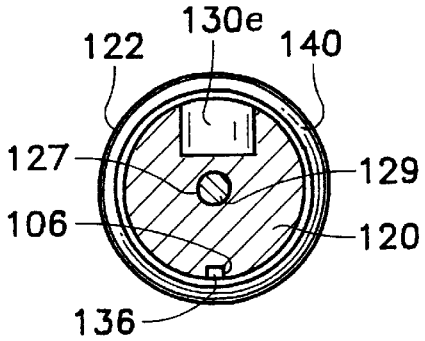
FIG. 6 is a cross-sectional view of the pill carrier of the embodiment shown in FIG. 5.
Figure 7:
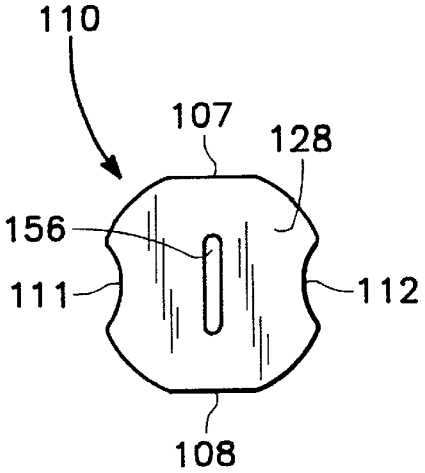
FIG. 7 is a cross-sectional view outside of the dispenser shown in FIG. 5.

FIGS. 5 through 7 show another embodiment of a pill dispenser 110 constructed in accordance with the principles of the present invention. The cross-section of the pill carrier 120 of the dispenser is generally round as shown in FIG. 6 and has pill cavities 130*a*–130*e* and a groove 106 diametrically opposed to the pill cavity 130 on the circumference of the pill carrier 120. The cross-section of the outer surface of the container is shown in FIG. 7. It has two flat surfaces 107 and 108 which are also diametrically opposed to each other on the circumference of the generally round cross-section of the container. Additionally, the outer surface has two finger grooves 111 and 112 also diametrically opposed to each other. These grooves 111 and 112, and flat surfaces 107 and 108, provide a type of "Braille" indicator such that the container can be properly oriented by the user in the dark or if the user's vision is impaired. A sheath 122 encases the pill carrier 120. The cavities 130*a*–130*e* for receiving the pills are located on the pill carrier 120 directly under and thereby covered by the slideable sheath 122. The pill carrier 120 has a longitudinal bore 127 through its center. A long pin 129 is disposed through the bore 127 in the pill carrier as shown in FIG. 5. One end of the pin 129 has a knurled cap 129 attached. On the other end of the pin 129 there are threads 126, designed to mate with a threaded hole 124 in the sheath 122. The pin is fixed within the bore 127 by a circle clip 131 or the like. A pin 136 located on the inner surface of sheath 122 fits in the groove 106 of the pill carrier 120 to prevent the pill carrier 120 from rotating relative to the sheath 122. A pressure relief channel 121 is provided at the closed aft end of the sheath and could, if desired, include the previously described two-way valve (not shown).

The user of the dispenser 110 of this embodiment slides the sheath 122 in relation to the pill carrier 120 by first twisting the knurled cap 128 to release the pill carrier 120. Once the threaded end of the pin 126 is screwed away from the threaded hole 124 of the sheath 122, the user then pulls the sheath 122 while holding onto the cap 128 to slide the pill carrier away from the threaded end 124 of the sheath 122 thereby exposing the first pill cavity 130*a*. An O-ring 140 provides an air and water-tight seal between the pill carrier 120 and the sheath 122 of the pill dispenser 110. Once opened, the pill dispenser 110 can be manipulated by one hand so that the pill contained within the cavity 130*a* can be popped into the user's mouth. In keeping with the practice of the invention and the realization of its advantages, a detent mechanism may again be provided in this embodiment similar to that described in the first embodiment of the present invention and shown in FIGS. 3 and 4. The knurled cap 128 may also have an eye stud 156 so as to allow the user to connect a chain or similar device, so that the dispenser can more easily be carried with the user.

This dispenser 110 is made of the same or similar materials as discussed previously for the embodiment of the invention shown in FIGS. 1 through 4. In addition, this embodiment of the invention enjoys all the advantages described in connection with the first embodiment. However, the present embodiment also has advantages of its own. For example, the pill carrier pill carrier 120 cannot rotate relative to the sheath 122 when the container is closed. This protects the pills from being powderized due to friction and vibrations that would be caused by the sheath 122 rotating relative to the pill carrier 120.

Figure 8B:
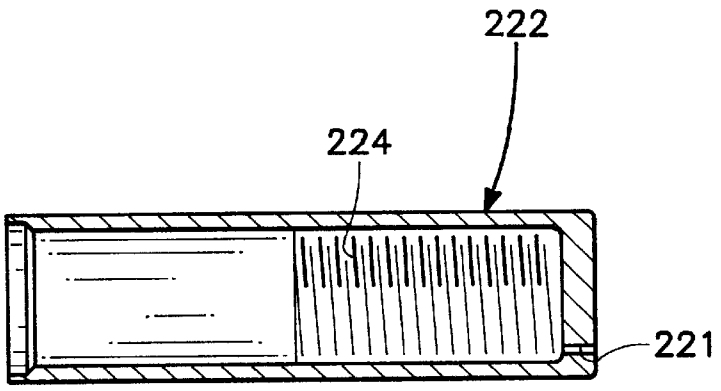
FIG. 8B is a cross-sectional view of the sheath employed with the pill carrier of FIG. 8A.
Figure 9:
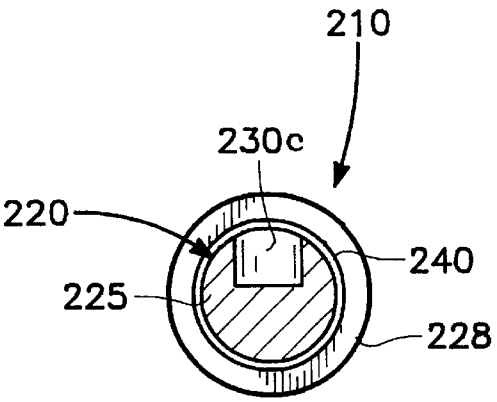
FIG. 9 is a cross-sectional view of the embodiment shown in FIG. 8.
Figure 8A:
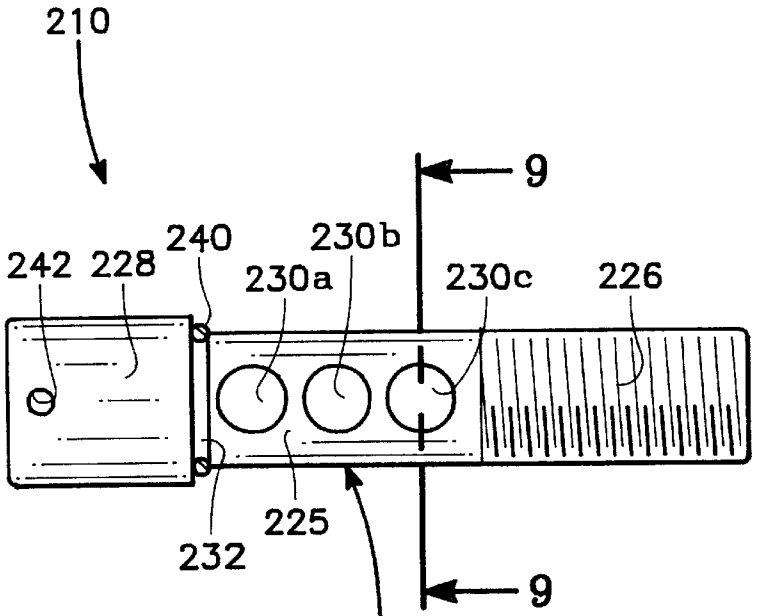
FIG. 8A is a planar view of the pill carrier of another embodiment of the present invention which employs a screw mechanism similar to that of a lipstick.

FIGS. 8A, 8B and 9 show another embodiment of the pill dispenser constructed in accordance with the principles of the present invention. The cross-section of the dispenser 210 is again generally round as shown in FIG. 9. The dispenser 210 includes as primary components a pill carrier 220 with a plurality of pill cavities 230*a*–230*c*, and a sheath 222 encasing the pill carrier 220. FIG. 9 shows the pill dispenser 210 as it appears before the cavities 230*a*–230*c* are filled with pills. When the dispenser is closed, the cavities 230*a*–230*c* are located on the pill carrier 220 directly under, and thereby covered by, the slideable sheath 222. The pill carrier 220 has a threaded end 226, designed to mate with threads 224 in the sheath 222 as shown in FIG. 8. The pill carrier 222, on the end opposite the threaded end, has an end cap 228. The user of the dispenser 210 of this embodiment unscrews the sheath 222 from the pill carrier 220 by twisting the cap end 228 in a manner similar to exposing the lipstick in a lipstick container. As the threaded end of the pill carrier 226 is screwed away from the threads 224 of the sheath 222, the pill cavities 230*a*–230*c* become exposed one at a time. Ideally, the threads of the pill carrier and the sheath are selected such that one pill cavity is exposed when the end cap 228 is twisted one ergonomic turn (approximately 140 degrees). The user can then simply extract the pill from the dispenser pill carrier or place it directly in his or her mouth. An O-ring 240 is seated in a groove 232 between the pill carrier end cap 228 and the pill carrier body 225 to provide an air and water-tight seal of the pill carrier 220 within the sheath 222. Once opened, this dispenser can then again be manipulated by one hand so that the pill contained within the cavity 230*a* can be placed into the user's mouth. The pill carrier end cap 228 also has a hole 242 which allows it to be threaded onto a chain or string and secured around one's neck or to, for example, a key chain or belt. This hole 242 (on the attached chain) additionally serves as a "Braille" indicator in that it is oriented in the same direction as the pill compartments 230*a*–230*c*. Additionally, indicia such as described in connection with the previous embodiment can be included to make the "top" of the dispenser readily ascertainable even in the dark. A detent mechanism (not shown) can also be used with this embodiment as described previously and shown in FIG. 4. A pressure relief channel 221 is provided at the closed aft end of the sheath and could, if desired, include the previously described two-way valve (not shown).

This dispenser 210 can be made of the same or similar materials as discussed previously for the embodiment of the invention shown in FIGS. 1 through 4. Additionally, this embodiment of the invention enjoys all the advantages described in connection with the first embodiment. However, the present embodiment also has advantages of its own. For example, an advantages of this embodiment includes that it has a fast thread; it requires minimal turning to fully expose each pill cavity.

Figure 10:
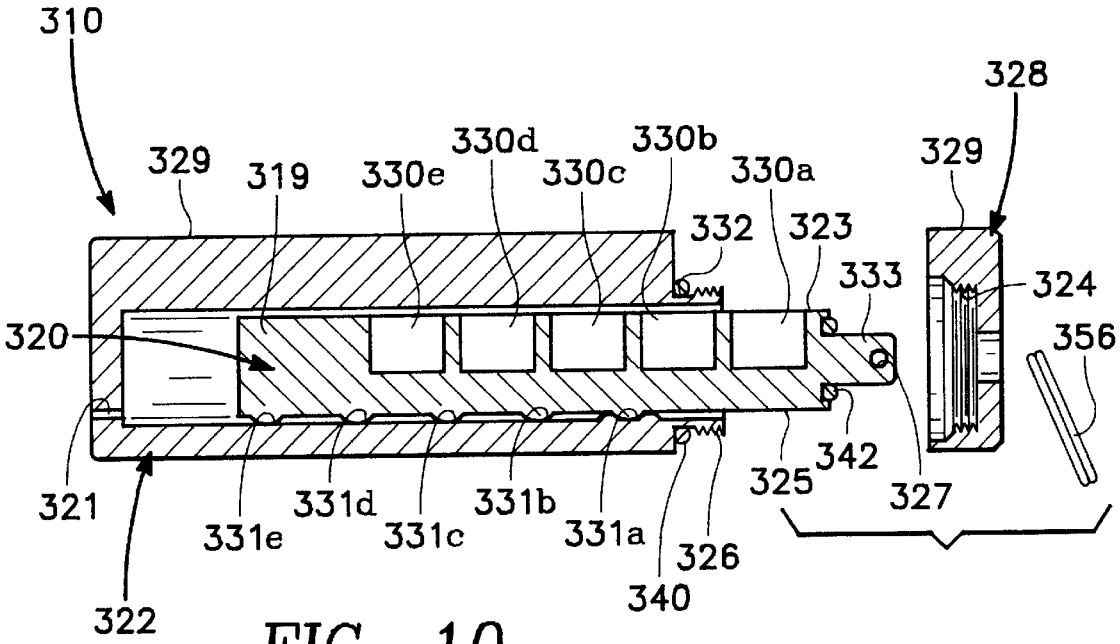
FIG. 10 is an exploded side view of another embodiment of the present invention which employs a removable end cap and sliding mechanism.
Figure 11:
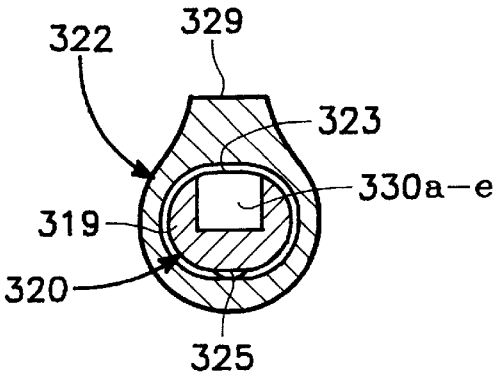
FIG. 11 is a cross-sectional view of the embodiment shown in FIG. 10.
Figure 12:
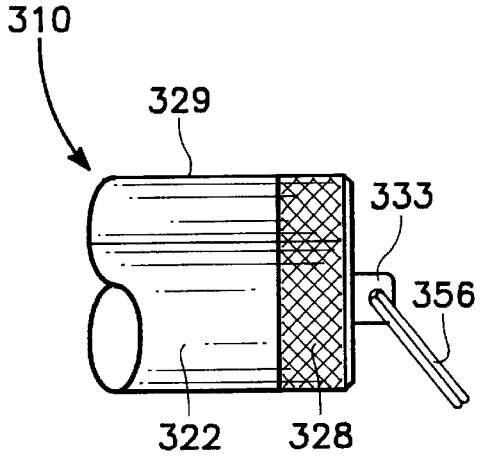
FIG. 12 is an enlarged side view of the assembled cap of the embodiment shown in FIG. 10.

FIGS. 10 and 11 show yet another embodiment of the pill dispenser constructed in accordance with the principles of the present invention. The dispenser 310 includes as primary components a pill carrier 320 with a plurality of pill cavities 330*a*–330*e*, a sheath 322 encasing the pill carrier 320, and a removable cap 328. The cross-section of both the sheath 322 and the removable cap 328 are generally pear-shaped having a flattened top surface 329 as shown in FIG. 11. The flattened top surface 329 of both the sheath 322 and the removable cap 328 acts as a "Braille" mechanism such that a user who is visually impaired or is using the dispenser in the dark will know to properly orient the dispenser to avoid dumping the pills out because the open end of the pill cavities corresponds to the flattened area. The pill carrier body 321 cross-section is generally oval in shape and has flattened sides 323 and 324 as shown in FIG. 10. Additionally, the pill carrier has a cylindrical extension 326 extending from the pill carrier body 321 which has a hole 327 for receiving a chain or ring 356 for carrying the dispenser around the users neck or on a key chain or the like. The sheath 322 has a threaded end 326, which is designed to mate with threads 324 in the cap 328 as shown in FIG. 10. The threads are chosen so that one ergonomic turn of the cap (about 140 degrees) releases it from the threaded end of the sheath. FIG. 12 shows a side view of the cap 328 sealed to the sheath 322. An O-ring 340 is seated in a groove 332 on the sheath 322. This O-ring 340 acts to provide an air and water-tight seal for the unexposed pills remaining in the pill carrier and protected by the sheath. An additional O-ring 342 is located at the base of the cylindrical extension 326 to provide an additional seal when all pills remain within the dispenser and the cap 328 is tightened on to the sheath 322. A pressure relief channel 321 is provided at the closed aft end of the sheath and could, if desired, include the previously described two-way valve (not shown).

The user of the dispenser 310 of this embodiment unscrews the cap 328 from the sheath 322 with a single turn release and then slides the sheath 322 away from the pill carrier 320 such that the pill cavities 330*a*–330*e* become exposed one at a time. The user can then simply extract the pill from the pill carrier with one hand to pop the pill into the user's mouth or hand.

The dispenser 310 also may have indexing bumps 331*a–e* on the side of the pill carrier body 321 opposite the pill cavities 330*a–e* as shown in FIG. 10, which will allow the user of the container to pull the pill carrier 320 out of the sheath 322 to expose one pill cavity 330 at a time. The last bump 331 on the pill carrier body 321 is larger than the remaining bumps, making the pill carrier 320 slightly more resistant to being separated from the sheath. In this manner the user the sheath 322 will not be accidentally separated from the pill carrier. The indexing bumps 331*a–e* are spaced a distance in direct correspondence to the spacing of the cavities 330*a–e* so as to stop the pill carrier each time a pill is exposed. Alternately, a detent mechanism as described above and shown in FIG. 4 may also be employed with this embodiment of the present invention for the same purpose.

This dispenser 310 is made of the same or similar materials as discussed previously for the first embodiment of the invention. Additionally, this embodiment of the invention enjoys all the advantages described in connection with this first embodiment. However, the present embodiment has advantages of its own. For example, unique advantages of this embodiment of the invention include the single turn release mechanism of the cap from the sheath makes the dispenser easy to use even for shaking, trembling or arthritic hands. Other unique advantages are that the pill carrier does not turn within the sheath. Additionally, there is an alternate detent mechanism provided.

Figure 13:
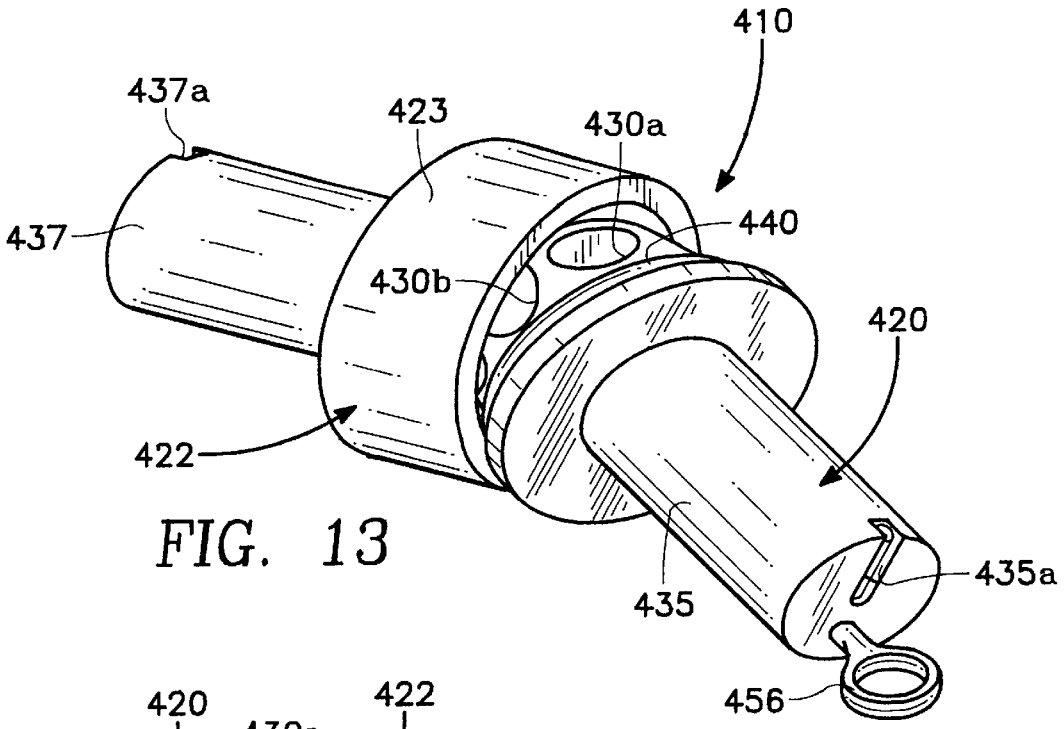
FIG. 13 is a side view of another embodiment of the present invention which employs a spring mechanism to hold the sheath in place relative to the pill carrier.
Figure 14:
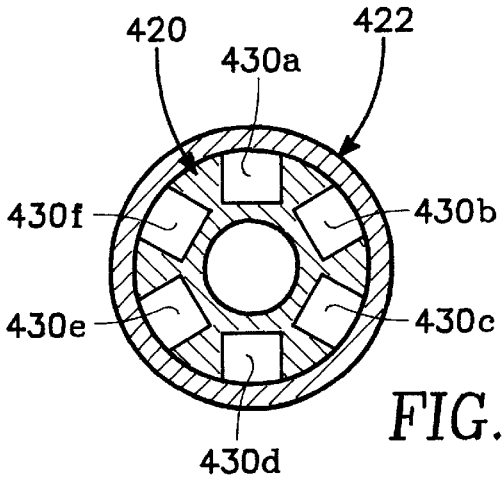
FIG. 14 is cross-sectional view of the embodiment shown in FIG. 13.
Figure 15:
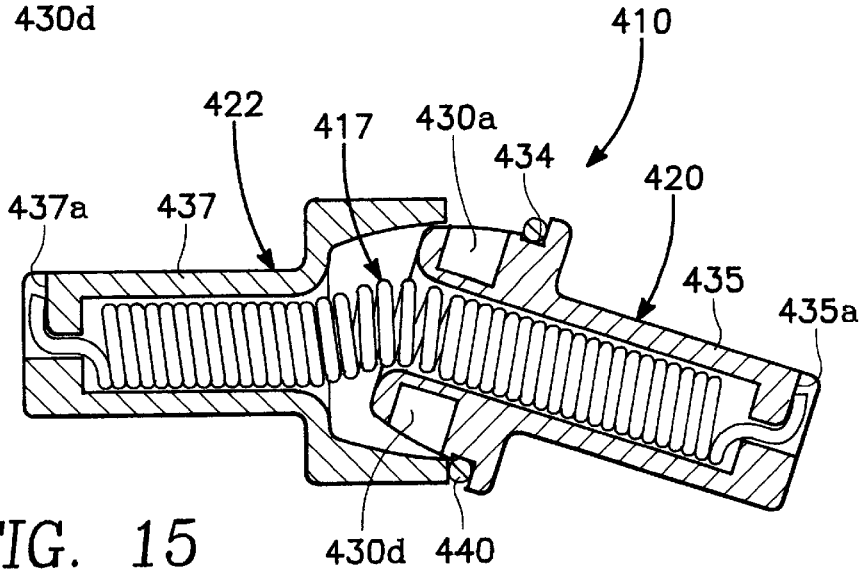
FIG. 15 is another cutaway side view of the embodiment of the invention shown in FIG. 13.

Another embodiment of the pill dispenser of the present invention is shown in FIGS. 13 through 15. This dispenser 410 has a pill carrier 420 having a circular cross-section as shown in FIG. 14. Six pill cavities 430*a*–430*f* are located around the circumference of the pill carrier. The pill carrier has a hollow cylindrical extension 435 which serves as a handle. A sheath 422 is provided having a hollow cylindrical hub-shaped cover 423 which is manufactured to fit tightly over the pill carrier 420 containing the pills. The sheath 422 also has a hollow cylindrical extension 437 which also serves as a handle. Both handles 435 and 437 have grooves 435*a* and 437*a* formed across their ends as shown in FIG. 15. A tension spring 417 is disposed within the handles 435 and 437 and attached to the ends thereof by the grooves 435*a* and 437*a* to hold the pill carrier and the sheath together to prevent them from separating. The pill carrying portion of the pill carrier 420 tapers away from the handle portion. In addition, the portion of the sheath 422 which interfaces with the pill carrying portion of the pill carrier has a cavity shaped so as to allow the pill carrying portion of the pill carrier to be tilted and rotated as shown in FIG. 15. An O-ring 440 is installed on the back of the pill carrying portion of the pill carrier in a groove 432 adjacent to a flange 434. The flange 434 prevents the O-ring 440 from being dislodged from the groove. The O-ring 440 provides an air and water-tight seal when the dispenser is in the closed position. The pill carrier handle 435 can be equipped with an eye hook 456 or the like for attaching a chain or ring such that the dispenser can be carried with the user at all times.

This embodiment of the present invention is opened by first pushing then tilting the pill carrier against the sheath. The pill carrier is then rotated together with the sheath as necessary for the pill to fall into the hand or mouth of the user. The pill cavities 430*a*–430*f* are spaced such that only one pill can be extracted at a time when the user tilts the sheath 422 relative to the pill carrier 420. The sheath 422 retains the remaining pills within the pill carrier 420.

This dispenser 410 is made of the same or similar materials as discussed previously for the first embodiment of the invention shown in FIGS. 1 through 4. Additionally, this embodiment of the invention enjoys all the advantages described in connection with the first embodiment. However, the present embodiment has advantages of its own. For example, the opening mechanism whereby the user pushes pill carrier and then tilts the sheath relative to the pill carrier makes the dispenser easy to use even for shaking, trembling or arthritic hands. Also, when the user releases pressure from the dispenser 410 when it is in the open position, the spring 417 automatically closes the dispenser. Other unique advantages are that the dispenser requires no indicia to indicate orientation of the pill cavities as only one pill is released at a time when the user tilts the sheath relative to the carrier. Hence, this dispenser can be easily used in the dark or while driving. Additionally, this particular embodiment allows one handed operation, making it easier to open the dispenser.

Figure 16A:
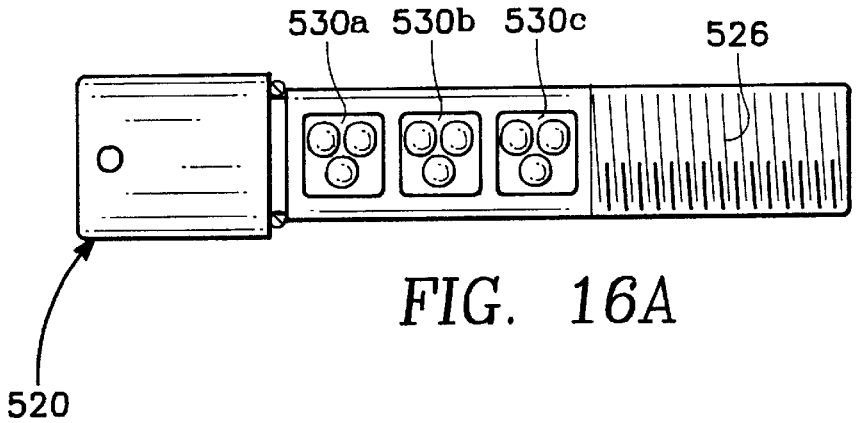
FIG. 16A is a planar view of the pill carrier of another embodiment of the present invention which has pill cavities sized to contain multiple pills per cavity.
Figure 16B:
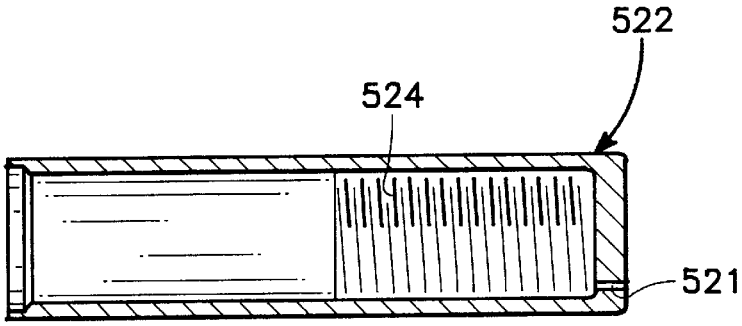
FIG. 16B is a cross-sectional view of the sheath employed with the pill carrier of FIG. 16A.

The cavities of the dispenser of any of the embodiments of the present invention could be made to contain multiple pills per cavity by making the cavities larger. An exemplary figure of such an embodiment of the invention is provided in FIG. 16. The depicted embodiment includes a pill carrier 520 and a sheath 522, both which have threaded ends 526 and 524, respectively and operates in a manner as discussed for the embodiment shown in FIGS. 8A, 8B and 9. The pill cavities 530*a*–530*c* are large enough to hold multiple pills.

Figure 17:
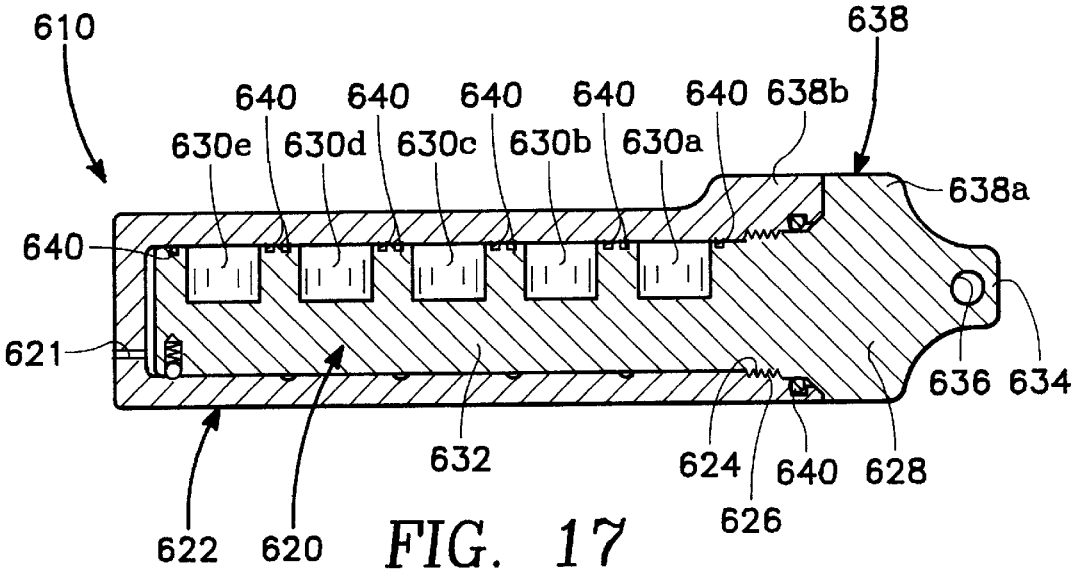
FIG. 17 is a side view of the pill dispenser constructed according to one embodiment of the invention employing a screw mechanism to turn the pill carrier relative to the sheath and a sliding scheme to open the container, wherein the threads are adjacent to the open end of the sheath.
Figure 18:
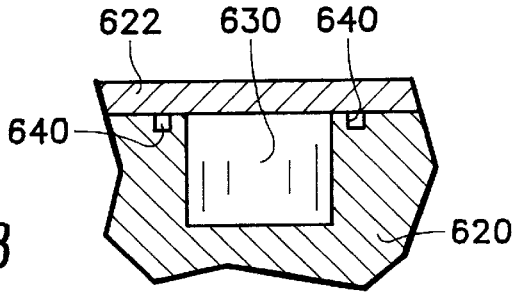
FIG. 18 is a cross-sectional view of the pill dispenser of FIG. 17.

FIGS. 17 and 18 show another embodiment of a pill dispenser 610 constructed in accordance with the principles of the present invention. The cross-section of the pill carrier 620 of the dispenser is generally round (although it can have a flattened side to prevent rolling as discussed previously) and has pill cavities 630*a*–630*e*. This embodiment is similar in most respects to, and enjoys all the benefits of, the pill dispenser embodiment described in conjunction with FIGS. 3 and 4. For example, it employs the detent mechanism and slots of the FIGS. 3 and 4 embodiment. However, the present embodiment employs a different thread design, cap and "Braille" indicator. Specifically, the sheath 622 has internal threads 624 at it open end, rather than its closed end. In addition, the pill carrier 620 has external threads 626 designed to mate with the thread 624 of the sheath formed in an area between the elongated section 632 containing the pill cavities 630 and the cap 628. An O-ring 640 provides an air and water-tight seal between the pill carrier 620 and the sheath 622 when the cap 628 is installed. A pressure relief channel 621 is provided at the closed aft end of the sheath and could, if desired, include the previously described two-way valve (not shown).

The user of the dispenser 610 of this embodiment slides the sheath 622 in relation to the pill carrier 620 by first unscrewing the sheath 622 to release the pill carrier 620. Preferably, this is accomplished by grasping the cap 628 and rotating the sheath 622. Once the cap 628 has been released from the threads 624 of the sheath, the user then pulls the sheath 622 while holding onto the cap 628 thereby exposing the first pill cavity 630*a*. Once opened, the pill dispenser 610 can be manipulated by one hand so that the pill contained within the cavity 630*a* can be popped into the user's mouth.

The cap 628 has a tang 634 extending away from its closed end. This tang 634 preferably has through-hole 636 to allow the user to connect a chain or similar device, so that the dispenser 610 can more easily be carried with the user. The cap 628 also includes part of the "Braille" indicator 638 employed with this embodiment. The other part of the indicator 638 is included one the outside of the sheath 622 adjacent its open end. The indicator 638 takes the form of a raised, elongated, block-shaped structure. The first part 638*a* of the structure attached to the exterior of the cap 628 has flat end which is flush with the open end of the cap, and coincides with the "top" of the pill carrier 620 (i.e. the side of the carrier containing the pill cavities 630). The flat end abuts a flat end associated with the second part 638*b* of the indicator structure when the cap 628 is fully installed on the sheath 622. In addition, the sides of the first and second parts 638*a*, 638*b* of the indicator structure align when the cap 628 is full installed. This interfacing scheme allows the user to determine which way the pill cavities 630 face, and when the cap is fully secured to the sheath, by touch alone; a significant advantage as discussed previously.

This dispenser 610 can be made of the same or similar materials as discussed previously for the embodiment of the invention shown in FIGS. 1 through 4. However, FIGS. 17 and 18 depict a dispenser 610 which employs a sheath 622 and pill carrier 620 made from Teflon (or a Teflon coated metal). Whenever Teflon or Teflon coating is employed in this manner, whether in this embodiment or any of the other embodiments of described previously, it is desirable to include small moisture grooves 640 surrounding each of the pill cavities 630. These grooves 640 improve the dispenser's ability to resist the infiltration of moisture along the interface between the pill carrier 620 and sheath 622, by trapping what moisture that may infiltrate in the grooves 640 before it can reach the pill contained within a pill cavity 630. The combination of a slight jam fit between a pill carrier 620 and sheath 622 made of Teflon or Teflon coated materials, the anti-wicking properties of Teflon, and the grooves 640, ensure the pills contained with in the pill cavities 630 are kept dry, even if the dispenser should get wet when it is open.

While this invention has been described in detail by specific reference to preferred embodiments thereof, it is understood that variations and modifications thereof may be made without departing from the true spirit and scope of the invention. For instance, all of the embodiments of the present invention could be pre-filled by the pill manufacturer. Additionally, the pill cavities of the pill carrier could be sealed with tape by the manufacturer to further enhance the protection of the pills against environmental effects. As another alternative, the dispenser's sheath or cap can be made to have a flattened side such that the dispenser will not roll when placed on a table or dropped on the ground. Additionally, the dispenser can be made to include a color coded marking to indicate, for instance, the type of medicine contained therein. This is particularly beneficial for people who must take many types of medicines. For example, the housing could be colored or color coded. Alternately, the housing could be made of a transparent plastic and the pill carrier could be colored or color coded. Further, the color or color coding employed could be made to match that used by the pill manufacture on the pills themselves. All of the embodiments of the present invention can be made to include "Braille" indicators such as flattened or roughened surfaces or other grooves or markings to allow a vision impaired person to open the dispenser without the aid of sight. The orientation of the pills within the pill cavities described in connection with the embodiments of the pill carriers constructed in accordance with the present invention need not be cylindrical. The cylindrical shaped cavities are useful for disc-shaped pills oriented on end within the pill cavities. However, other shapes of pills and other orientations are also possible. The pill cavities would be sized and shaped to match the type of pills and their preferred orientations. For example, a pill carrier used in conjunction with capsules oriented on their edge would have oblong shaped pill cavities. Another example would be a pill carrier with rectangular, slot-like pill cavities. These cavities could be used to hold disc-shaped pills in an on edge orientation. Such an orientation has some advantage in that, even though the pill dispenser would have to have a larger cross-section size than one having disc-shaped pills in an on end orientation, many more pills could be held in a dispenser of the same length.

Wherefore, having thus described the present invention, what is claimed is:

1. A pill dispenser comprising:

a pill carrier having a plurality of pill cavities spaced apart on one side of said pill carrier, said pill carrier further comprising an elongated section wherein the plurality of pill cavities are aligned longitudinally along an external surface of the elongated section; and a hollow sheath capable of encasing the entire length of said pill carrier, said sheath being displaceable in relation to the pill carrier so as to sequentially expose each pill cavity adjacent an open end of the sheath; and wherein the open end of the sheath is a first end and the sheath has internal threads adjacent thereto, and said pill carrier comprises an end cap at a first end thereof extending from the open end of the sheath and external threads at an area adjacent the end cap, and said external threads of the pill carrier are threadably engageable to the internal threads of the sheath such that when the sheath is fully rotated in relation to the end cap in a first direction the end cap abuts the open end of the sheath and the elongated section of the pill carrier is retained within the sheath, and when the sheath is rotated in a second direction until the pill carrier threads are free from engagement with the sheath threads, the sheath becomes longitudinally displaceable in relation to the pill carrier.

2. The pill dispenser of claim 1, wherein the end of the sheath opposite said open end is closed and comprises a pressure relief element.

3. The pill dispenser of claim 2, wherein the pressure relief element comprises a through-hole in the closed end of the sheath.

4. The pill dispenser of claim 2, wherein the pressure relief element comprises a two-way valve capable of allowing air into the sheath only when the pill carrier is moved out of the sheath and allowing air out of the sheath only when the pill carrier is moved into the sheath.

5. The pill dispenser of claim 1 further comprising:

a sealing mechanism capable of providing a water-tight and air-tight seal between said pill cavities and the outside environment.

6. The pill dispenser of claim 5 wherein said pill carrier has a first and second end; and said sealing mechanism comprises, a first O-ring disposed at said first end of said pill carrier providing a seal at said first end of said pill carrier, a second O-ring disposed at said second end of said pill carrier providing a seal at said second end of said pill carrier.

7. The pill dispenser of claim 1 further comprising a detent mechanism capable of releasably stopping said sheath in relation to said pill carrier after each cavity of said plurality of cavities has been uncovered.

8. The pill dispenser of claim 1 further comprising external indicium providing an indication of the orientation of said pill cavities.

9. The pill dispenser of claim 8 wherein said indicium is a groove.

10. The pill dispenser of claim 8 wherein said indicium comprises an end cap connected to an end of said pill carrier, said end cap having two diametrically opposed flat sides, and two diametrically opposed finger grooves perpendicular to the flat sides.

11. The pill dispenser of claim 8 wherein said indicium comprises said sheath having a flattened top surface and said pill carrier having an end cap, said end cap having a flattened top surface.

12. The pill dispenser of claim 1 wherein each of said pill cavities is sized and shaped so as to be larger than the size of a pill only to the degree necessary to ensure a free egress of a pill installed within a pill cavity of the pill carrier.

13. The pill dispenser of claim 1 wherein each of said pill cavities is sized and shaped to receive multiple pills.

14. The pill dispenser of claim 1 further comprising an attachment structure capable of receiving one of (i) a chain, or (ii) a ring.

15. The pill dispenser of claim 1 wherein:

said pill carrier has a circular cross-section; and said sheath has a circular cross-section.

16. A pill dispenser comprising:

a pill carrier having a plurality of pill cavities spaced apart on one side of said pill carrier, said pill carrier further comprising an elongated section wherein the plurality of pill cavities are aligned longitudinally along an external surface of the elongated section; and a hollow sheath capable of encasing the entire length of said pill carrier, said sheath being displaceable in relation to the pill carrier so as to sequentially expose each pill cavity adjacent an open end of the sheath; and wherein the open end of the sheath is a first end and the sheath has internal threads at a second end thereof, and said pill carrier comprises an end cap at a first end thereof extending from the open end of the sheath and external threads at a second end thereof, and said external threads of the pill carrier are threadably engageable to the internal threads of the sheath such that when the end cap is fully rotated in relation to the sheath in a first direction the end cap abuts the open end of the sheath and the elongated section of the pill carrier is retained within the sheath, and when the end cap is rotated in a second direction until the pill carrier threads are free from engagement with the sheath threads, the sheath becomes longitudinally displaceable in relation to the pill carrier.

17. The pill dispenser of claim 16, wherein the end cap and external threads of the pill carrier are connected together by a shaft, said shaft being disposed within a longitudinal channel formed through the center of the elongated section of the pill carrier, and wherein the end cap and external threads of the pill carrier are rotatable in relation to the elongated section of the pill carrier; and the pill carrier comprises an external groove extending along the outside of the elongated section of the pill carrier and the sheath comprises a pin extending from the interior surface of the sheath, said pin being slidably engageable within said groove such that the elongated section of the pill carrier is prevented from rotating in relation to the sheath.

18. The pill dispenser of claim 1 wherein the dispenser is made of material which is light weight, opaque and non-reactive to pills contained within said dispenser.

19. The pill dispenser of claim 1 wherein the dispenser is made of aluminum.

20. The pill dispenser of claim 1 wherein the dispenser is made of Teflon coated with aluminum.

21. The pill dispenser of claim 1 wherein the dispenser is made of Teflon.

22. The pill dispenser of claim 1 wherein the dispenser is made of aluminum coated with Teflon.

23. The pill dispenser of claim 1 wherein the pill carrier is of a size such that it can be place into a user's mouth, thereby allowing a pill contained within one of said pill cavities to be dispensed directly into the user's mouth.

24. The pill dispenser of claim 18 wherein the material further exhibits a low coefficient of heat transfer.

25. A pill dispenser comprising:

a pill carrier having a plurality of pill cavities spaced apart on one side of said pill carrier, said pill carrier further comprising an elongated section wherein the plurality of pill cavities are aligned longitudinally along an external surface of the elongated section; and a hollow sheath capable of encasing the entire length of said pill carrier, said sheath being displaceable in relation to the pill carrier so as to sequentially expose each pill cavity adjacent an open end of the sheath; and wherein the open end of the sheath is a first end and the sheath has internal threads at a second end thereof, and said pill carrier comprises an end cap at a first end thereof extending from the open end of the sheath and external threads at a second end thereof, and said external threads of the pill carrier are threadably engageable to the internal threads of the sheath such that when the end cap is fully rotated in relation to the sheath in a first direction the end cap abuts the open end of the sheath and the elongated section of the pill carrier is retained within the sheath, and when the end cap is rotated in a second direction, the elongated section of the pill carrier is driven out of the sheath such that the pill cavities are exposed one at a time.

26. The pill carrier of claim 25 wherein the end cap is rotated one ergonomic turn to respectively expose each pill cavity.

27. A pill dispenser comprising:

a pill carrier having a plurality of pill cavities spaced apart on one side of said pill carrier, said pill carrier further comprising an elongated section wherein the plurality of pill cavities are aligned longitudinally along an external surface of the elongated section; and a hollow sheath capable of encasing the entire length of said pill carrier, said sheath being displaceable in relation to the pill carrier so as to sequentially expose each pill cavity adjacent an open end of the sheath; and wherein said sheath comprises, a flat internal surface on a top side thereof and external threads adjacent the open end of the sheath;

said elongated section of the pill carrier comprises a flat surface corresponding to the side having said pill cavities, and the flat surface of the pill carrier is in slidable engagement with the flat surface of the sheath so as to prevent rotation of the pill carrier in relation to the sheath.

28. The pill dispenser of claim 27 further comprising:

an end cap having internal threads engageable with the external threads of the sheath; and wherein whenever the threads of the end cap are fully engaged with the threads of the sheath, the pill carrier is held within the sheath, and whenever the end cap is removed from the sheath, the sheath becomes longitudinally displaceable in relation to the pill carrier.

29. A pill dispenser comprising:

a pill carrier having a plurality of pill cavities spaced apart on one side of said pill carrier; and a hollow sheath capable of encasing the entire length of said pill carrier, said sheath being displaceable in relation to the pill carrier so as to sequentially expose each pill cavity adjacent an open end of the sheath; and wherein said pill carrier has a tapered cylindrical shape with the pill cavities being arranged around the circumference of the external surface of the pill carrier; and said sheath has an internal cavity shape so as to allow the pill carrier to be tilted at an angle in relation to the sheath without interference.

30. The pill dispenser of claim 29, wherein said pill carrier further comprises a handle section extending from an end of the pill carrier opposite the sheath, said pill carrier and handle section having a first common internal longitudinal channel open at the pill carrier end thereof; and said sheath further comprises a handle extending from an end of the sheath opposite the pill carrier, said sheath and handle having a second common internal longitudinal channel open at the sheath end thereof; and wherein the pill dispenser further comprises a tension spring stretched under tension within said first and second common channels and affixed at a first end to the end of the first common channel opposite the open end thereof and affixed at a second end to the end of the second common channel opposite the open end thereof, and wherein the sheath is pivoted in relation to the pill carrier via forces applied by a user on the handle section of the pill carrier and handle associated with the sheath such that the pill carrier is tilted in relation to the sheath against a tension force applied by the tension spring to fully expose a single one of the pill cavities.

31. The pill dispenser of claim 30, wherein the pill carrier and sheath are capable of being rotated together while the pill carrier is tilted in relation to the sheath so as to sequentially expose other of the pill cavities.

32. The pill dispenser of claim 30, wherein the tension force applied by the tension spring is capable of returning the pill carrier from a tilted relationship with said sheath to a relationship wherein the pill carrier is encased within the sheath whenever said force applied by the user are removed.

33. The pill dispenser of claim 16 further comprising:

a sealing mechanism capable of providing a water-tight and air-tight seal between said pill cavities and the outside environment.

34. The pill dispenser of claim 16 further comprising a detent mechanism capable of releasably stopping said sheath in relation to said pill carrier after each cavity of said plurality of cavities has been uncovered.

35. The pill dispenser of claim 16 further comprising external indicium providing an indication of the orientation of said pill cavities.

36. The pill dispenser of claim 16 wherein each of said pill cavities is sized and shaped so as to be larger than the size of a pill only to the degree necessary to ensure a free egress of a pill installed within a pill cavity of the pill carrier.

37. The pill dispenser of claim 16 wherein each of said pill cavities is sized and shaped to receive multiple pills.

38. The pill dispenser of claim 16 wherein the dispenser is made of material which is light weight, opaque and non-reactive to pills contained within said dispenser.

39. The pill dispenser of claim 16 wherein the pill carrier is of a size such that it can be place into a user's mouth, thereby allowing a pill contained within one of said pill cavities to be dispensed directly into the user's mouth.

40. The pill dispenser of claim 16, wherein the end of the sheath opposite said open end is closed and comprises a pressure relief element.

41. The pill dispenser of claim 25 further comprising:

a sealing mechanism capable of providing a water-tight and air-tight seal between said pill cavities and the outside environment.

42. The pill dispenser of claim 25 further comprising a detent mechanism capable of releasably stopping said sheath in relation to said pill carrier after each cavity of said plurality of cavities has been uncovered.

43. The pill dispenser of claim 25 further comprising external indicium providing an indication of the orientation of said pill cavities.

44. The pill dispenser of claim 25 wherein each of said pill cavities is sized and shaped so as to be larger than the size of a pill only to the degree necessary to ensure a free egress of a pill installed within a pill cavity of the pill carrier.

45. The pill dispenser of claim 25 wherein each of said pill cavities is sized and shaped to receive multiple pills.

46. The pill dispenser of claim 25 wherein the dispenser is made of material which is light weight, opaque and non-reactive to pills contained within said dispenser.

47. The pill dispenser of claim 25 wherein the pill carrier is of a size such that it can be place into a user's mouth, thereby allowing a pill contained within one of said pill cavities to be dispensed directly into the user's mouth.

48. The pill dispenser of claim 25, wherein the end of the sheath opposite said open end is closed and comprises a pressure relief element.

49. The pill dispenser of claim 27 further comprising:

a sealing mechanism capable of providing a water-tight and air-tight seal between said pill cavities and the outside environment.

50. The pill dispenser of claim 27 further comprising a detent mechanism capable of releasably stopping said sheath in relation to said pill carrier after each cavity of said plurality of cavities has been uncovered.

51. The pill dispenser of claim 27 further comprising external indicium providing an indication of the orientation of said pill cavities.

52. The pill dispenser of claim 27 wherein each of said pill cavities is sized and shaped so as to be larger than the size of a pill only to the degree necessary to ensure a free egress of a pill installed within a pill cavity of the pill carrier.

53. The pill dispenser of claim 27 wherein each of said pill cavities is sized and shaped to receive multiple pills.

54. The pill dispenser of claim 27 wherein the dispenser is made of material which is light weight, opaque and non-reactive to pills contained within said dispenser.

55. The pill dispenser of claim 27 wherein the pill carrier is of a size such that it can be place into a user's mouth, thereby allowing a pill contained within one of said pill cavities to be dispensed directly into the user's mouth.

56. The pill dispenser of claim 27, wherein the end of the sheath opposite said open end is closed and comprises pressure relief element.

57. The pill dispenser of claim 29 further comprising:

a sealing mechanism capable of providing a water-tight and air-tight seal between said pill cavities and the outside environment.

58. The pill dispenser of claim 29 wherein each of said pill cavities is sized and shaped so as to be larger than the size of a pill only to the degree necessary to ensure a free egress of a pill installed within a pill cavity of the pill carrier.

59. The pill dispenser of claim 29 wherein each of said pill cavities is sized and shaped to receive multiple pills.

60. The pill dispenser of claim 29 wherein the dispenser is made of material which is light weight, opaque and non-reactive to pills contained within said dispenser.

* * * * *